US005462097A

United States Patent [19]

Skalka

[11] Patent Number: 5,462,097

[45] Date of Patent: Oct. 31, 1995

[54] PIEZOELECTRIC DEVICES FOR YARN CONTROL APPARATUS IN A TEXTILE MACHINE

[75] Inventor: Ivan Skalka, Vsetin, Czech Rep.

[73] Assignee: Textilma AG, Hergiswil, Switzerland

[21] Appl. No.: 244,652

[22] PCT Filed: Oct. 7, 1993

[86] PCT No.: PCT/CH93/00239

§ 371 Date: Jun. 6, 1994

§ 102(e) Date: Jun. 6, 1994

[87] PCT Pub. No.: WO94/09197

PCT Pub. Date: Apr. 28, 1994

[30] Foreign Application Priority Data

Oct. 9, 1992 [CZ] Czech Rep. ..... 2094-93

[51] Int. Cl.[6] ..... D03C 3/20; D03C 13/00; D04B 27/32

[52] U.S. Cl. ..... 139/455; 66/218

[58] Field of Search ..... 139/59, 455; 66/218, 66/219

[56] References Cited

U.S. PATENT DOCUMENTS

| | | | |
|---|---|---|---|
| 3,828,826 | 8/1974 | Hurzeler et al. | 66/218 |
| 3,871,415 | 3/1975 | Wolfgang et al. | 139/59 |
| 4,830,386 | 5/1989 | Snoke et al. | 280/38 |
| 5,027,619 | 7/1991 | Saito | 66/218 |
| 5,042,274 | 8/1991 | Maruyama et al. | 66/218 |

FOREIGN PATENT DOCUMENTS

| | | | |
|---|---|---|---|
| 0210790 | 2/1987 | European Pat. Off. | 66/218 |
| 2019534 | 1/1990 | Japan | 139/455 |

*Primary Examiner*—Andy Falik
*Attorney, Agent, or Firm*—Anderson Kill Olick & Oshinsky

[57] ABSTRACT

A traction member (22) is connected to a yarn (6) which is to be controlled. A coupling assembly (38) serves for coupling the traction member (22) to a lifting device (32). A coupling assembly (38) contains a link pin (40), which can reciprocate between a neutral position and a coupling engaged position, with two piezoelectric switching members (50, 52) which function respectively alternately as actuator and sensor being allocated to said link pin 40. This results not only in a particularly simple coupling construction, rather also in a monitoring of the switching function of the coupling, wherein switching errors and switching malfunctions can be avoided.

13 Claims, 5 Drawing Sheets

PIEZOELECTRIC DEVICES FOR YARN CONTROL APPARATUS IN A TEXTILE MACHINE

BACKGROUND OF THE INVENTION

1. Field of the Invention

The invention deals with a control device for a yarn or thread of a textile machine having a traction member connected to the yarn, with the traction member being connectable by a coupling assembly with a lifting device, and with the coupling assembly being controlled by a piezoelectric switching member. Such a control device is for instance suited for controlling a single yarn or thread, however also for a Jacquard- or dobby loom of a weaving- or knitting machine.

2. Description of the Prior Art

Numerous control devices for the thread of a textile machine are known, thus the DE-OS 21 30 502 describes for instance a control arrangement of the above-named type in a Jacquard machine for textile machines. The Jacquard machine contains a plurality of traction members as well as a lifting device for raising or lowering traction members selected according to the pattern. A coupling arrangement serves for selecting the traction members in accordance with the pattern. A piezoelectric switching member controls the coupling assembly. However herein it is disadvantageous, that the build-up of the device is extraordinarily complicated and that the piezoelectric switching member serves only as a substitute organ, which controls the drive means which themselves cause the coupling or uncoupling to happen. Herein it is additionally impossible to monitor the operational state of the coupling arrangement.

SUMMARY OF THE INVENTION

It is the object of the invention to design a control device of the type described above in such a way that the mentioned disadvantages are eliminated.

The object of the invention is achieved by providing a control device of the previously mentioned type the coupling assembly of which comprises a coupling link pin reciprocating between neutral and engaged positions, with two piezoelectric switching members being associated with the link pin and acting alternately as actuators and sensors having two piezoelectric switching members serve alternately as an actuator and a sensor and by having them move the coupling link pin to and fro between a neutral position and a coupling engaged position, there results an extraordinarily simple apparatus, since the piezoelectric switching members serve directly for controlling and for driving of the link pin and do not require any additional driving means. Since the piezoelectric switching members serve alternately not only as actuator rather also as sensor, they serve at the same time for monitoring the state of the coupling. Thus a control device results which incorporates an extremely simple build-up with simultaneous simple control and the greatest degree of security or safety.

BRIEF DESCRIPTION OF THE DRAWING

Embodiment examples of the subject in the invention are described with particularity in the following with the help of the drawings. It is shown on.

DETAILED DESCRIPTION OF THE PREFERRED EMBODIMENTS

Figure 2:
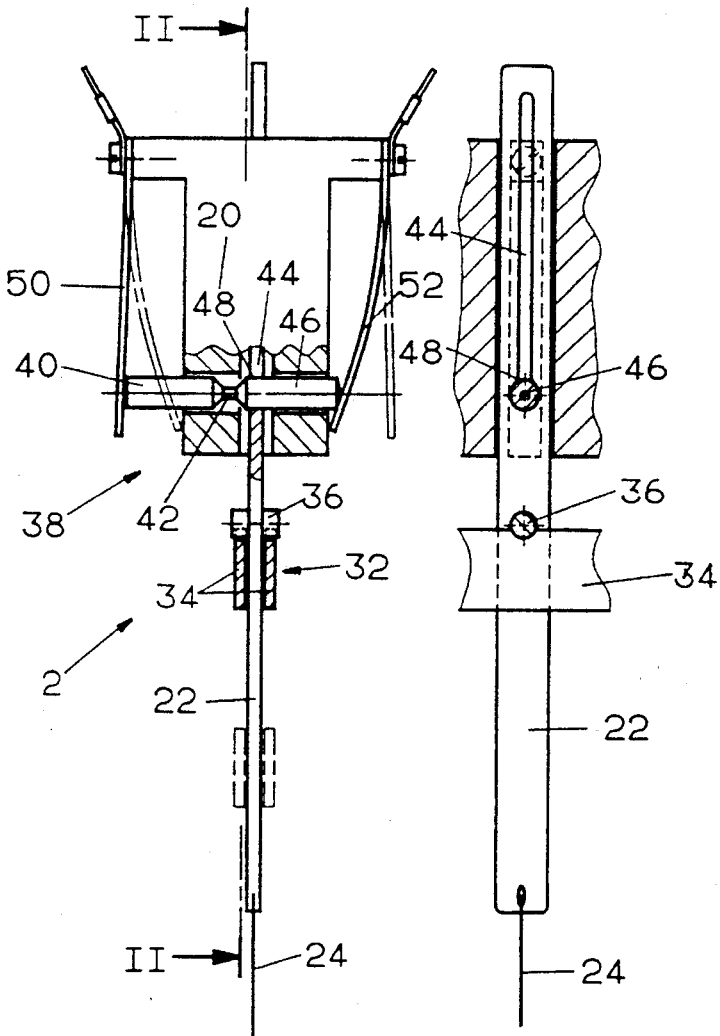
FIG. 2 the control device in FIG. 1 in section along the line II—II.

FIGS. 1, 2, 3*a*, 3*b* and 3*c* show a first embodiment example of the invented control device 2 at a weaving machine 4. The weaving machine shown only diagrammatically contains warp yarns 6, which can be brought into a high position 6*a* or a low position 6*b* by the control device 2 for forming an open shed 8. A filling or weft yarn 10 is shot through the open shed 8 and is beat up at the edge 14 by a weaving reed 12. The cloth or tissue 16 thus produced is drawn off by a cloth or tissue take-off device 18.

The control device 2 contains a stationary block 20, in which a traction member 22 is guided so as to be able to move upwards and downwards. The traction member 22 configured in a laminar fashion is connected at its bottom end to a heddle 26 through a connector element 24, for instance a traction cord, with the heddle 26 containing a heddle eye 28 through which the warp yarn 6 is guided. The heddle 26 and with it also the traction member 22 are preloaded in a downward direction by a return spring 30. A lifting device 32 with lifting knives 34 disposed on both sides of the laminations cooperates with a drive cam 36 disposed at the traction member 22. The design of the drive of the lifting device 32 and the lifting knives 34 is sufficiently known so that it does not need to be described in detail here. The traction member 22 is preloaded in a downward direction by the return spring 30, this means it is preloaded in the low position 6*b* of the warp yarn 6. In order to bring the warp thread 6 into the high position 6*a* and to hold it there, the lifting knives 34 lift the lifting member 22 by means of the drive cam 36 to such an extent until the high position 6*a* of the warp yarn 6 is reached. A coupling arrangement 38 serves for retaining the traction member 22 in the raised position or for release of same, so that the traction member 22 can follow the lowering of the lifting knife under the action of the return spring.

The coupling assembly 38 comprises a link pin 40 supported on both sides of the traction member 22 in the block 20 so as to be displaceable in a reciprocating manner. The link pin 40 comprises a narrow guidance segment 42 engaging into a longitudinal slot 44 of the traction member and permitting the upward and downward motion of the traction member with simultaneous guidance of same. Furthermore the link pin comprises a wide link segment 46 which can snap into a coupling bore 48 in the traction member and in such a position can retain the guide member in the assumed position corresponding to the high position of the warp yarn 6.

Two piezoelectric switching members 50, 52 disposed on the block 20 on both sides of the link pin and which cooact with the ends of the link pin serve for creating the reciprocating motion meaning for controlling the link pin. The piezoelectric switching members 50, 52 serve alternately as actuator and as sensor.

Figure 1:
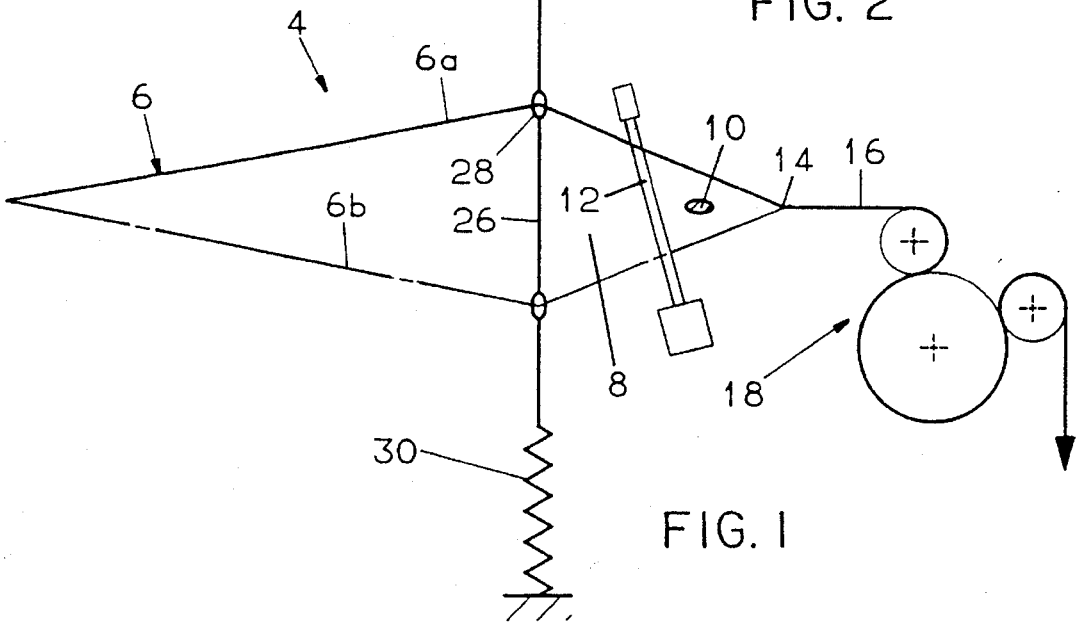
FIG. 1 A control device for controlling the warp thread of a weaving machine, partially in section and in diagrammatic illustration and in front view transversely to the longitudinal direction of the warp thread or warp yarn.
Figure 3A:
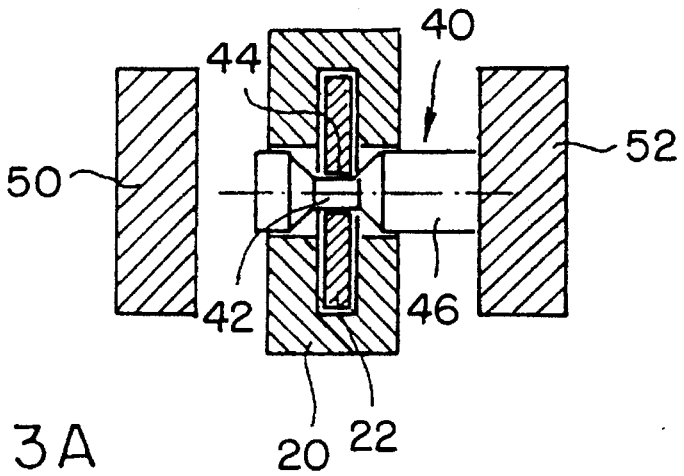
FIGS. 3*a* to 3*c* the functional mode of the control device in FIG. 1 in different shift positions of the link pin in diagrammatic presentation.
Figure 3B:
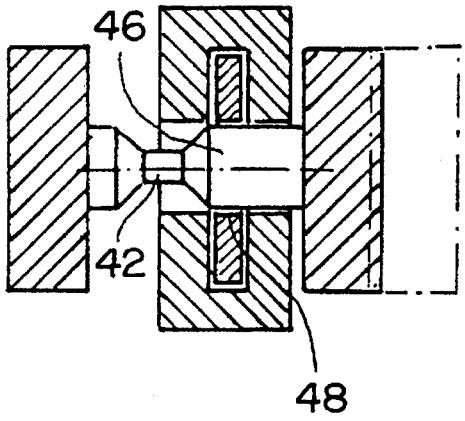
Figure 3C:
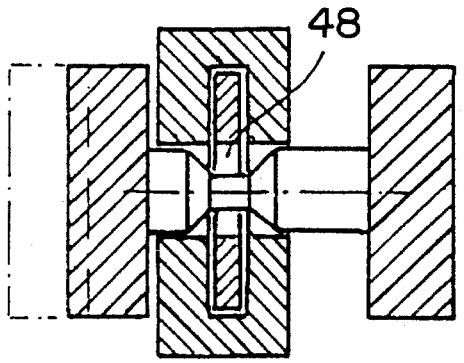

The functional mode of the link pin and the switching members 50, 52 is explained in even more detail with the help of FIG. 1 but in particular by the diagrams on FIGS. 3*a* to 3*c*. If the switching members 50, 52 do not carry any current, the link pin 40 assumes the basic position shown in FIG. 3*a*, where the guidance segment 42 engages into the longitudinal slot 44 of the traction member 22. Herein the link pin contacts a switching member 52 and exerts a certain pressure on this switching member, which thereby functions as a sensor and sends a current pulse to an electronic control unit, which has not been depicted in detail here, thus indicating the position assumed by the link pin at this time. In order to shift the link pin, current is applied to a respective one of the switching members, for instance the right hand switching member 52 FIG. 3*a*, wherein the piezoelectric switching member bends or assumes a curved position and herein displaces the link pin from the right hand position into the left hand position, so that the wide pin segment 46 of the link pin snaps into the coupling bore 48 of the traction member 22 thus preventing further movement of the traction member. In the course of this shifting process the link pin is pressed against the other switching member 50 as is evident from FIG. 3*b* and it produces a control current there, which again indicates the assumed position of the link pin to the electronic control device not shown in detail here. The thus assumed position of the link pin where the traction member 22 is arrested in the high position is maintained until another control pulse causes the left hand switching member 50 to press the link pin back into the initial position as this is evident from FIG. 3*c*, in which the narrow guidance segment 42 again cooperates with the longitudinal slot 44 in the traction member. The piezoelectric switching members 50, 52 thus act alternately on the one hand as actuators causing displacement of the link pin and on the other hand as sensors which indicate the correct assumed position of the link pin to the electronic control device.

Figure 4:
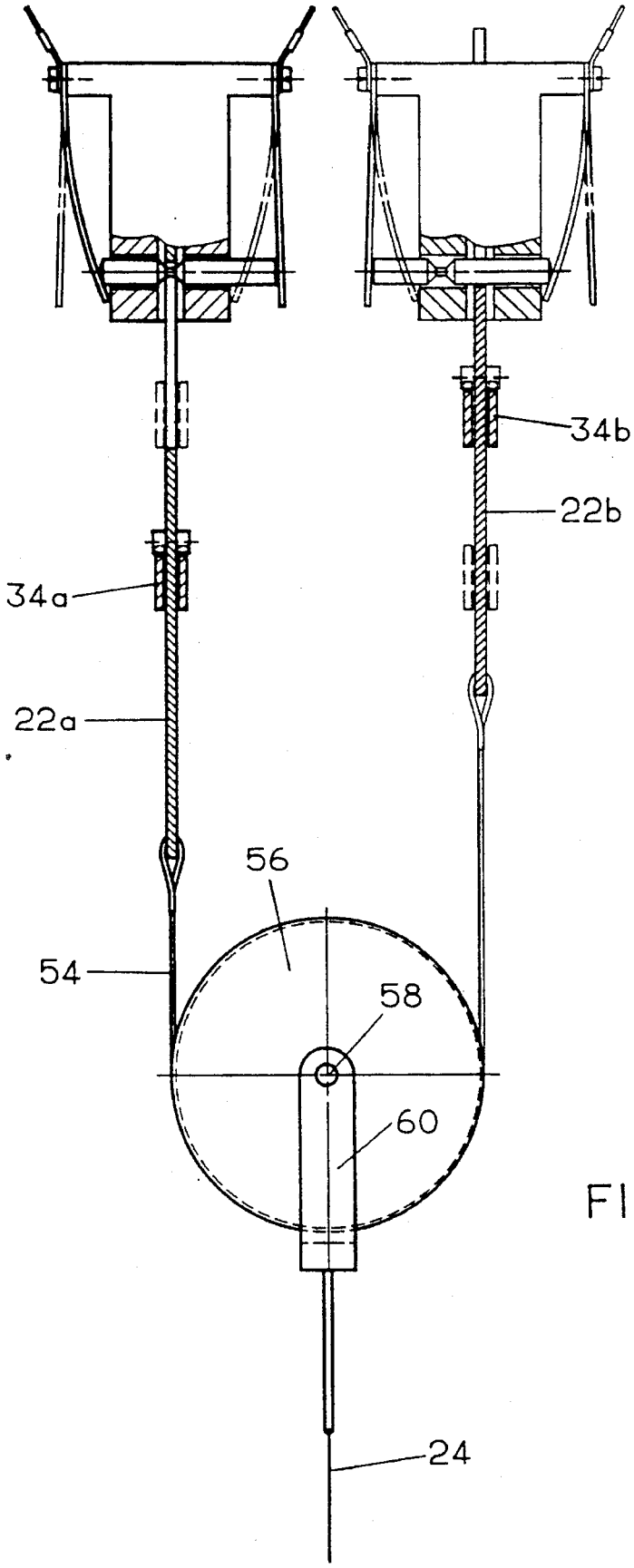
FIG. 4 a control device with two traction members according to the double lift principle for controlling a warp thread of a weaving machine analogously to the apparatus in FIG. 1, in front view transversely to the longitudinal direction of the warp thread.

FIG. 4 shows the refinement of the control device in FIGS. 1 to 3 at the example of a double lift apparatus, as it is for instance described in the U.S. Pat. No. 3,835,894. In this control device there exist two lifting members 22*a*, 22*b* as well as a lifting device 32*a* with two pairs of lifting knives 34*a* and 34*b* acting one against the other. The lifting members 22*a* and 22*b* are connected with each other by a connecting cable 54 guided over a reversing roller 56. The bearing fork 60 is supported on the axis 58 of the reversing roller 56, with a flexible connector element 24 being fastened thereto, thus establishing the connection to the heddle 26 and with this to the warp thread 6. The mode of operation of the double lifting system is known and the control is performed analogously to the example in FIGS. 1 to 3*c*.

Figure 5:
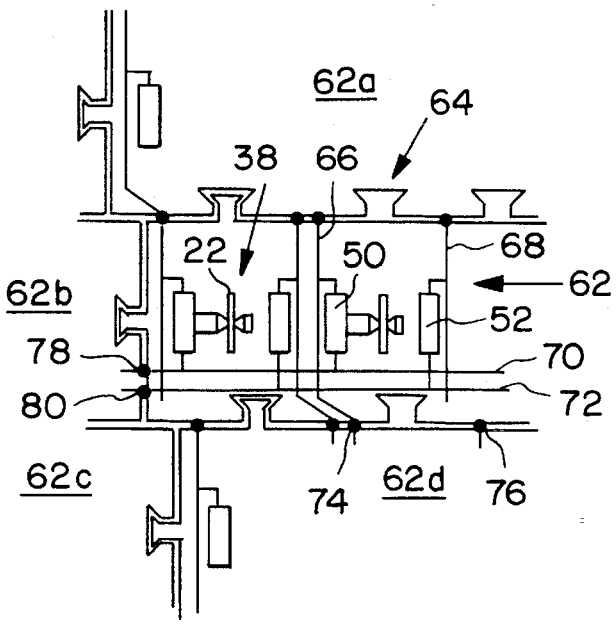
FIG. 5 control device with group-like disposition of traction members and assigned thereto link pins and electrical actuation, shown diagrammatically.

As is evident from FIG. 5, one or several coupling arrangements 38 and appropriate traction members 22 can be combined into a modular unit 62, which can be connected by connector means 64, for instance dovetail connections, with corresponding modular units 62, 62*a*, 62*b*, 62*c*, 62*d*. The individual switching members 50, 52 are connected to wires 66, 68 or 70, 72 which end at contact points 74, 76 or 78, 80 which cooperate with corresponding contact points of modular units 62, 62*a*, 62*b*, 62*c*, 62*d* connected therewith. The wires 66, 68, 70, 72 constitute a matrix for controlling the switching members 50, 52.

Figure 6:
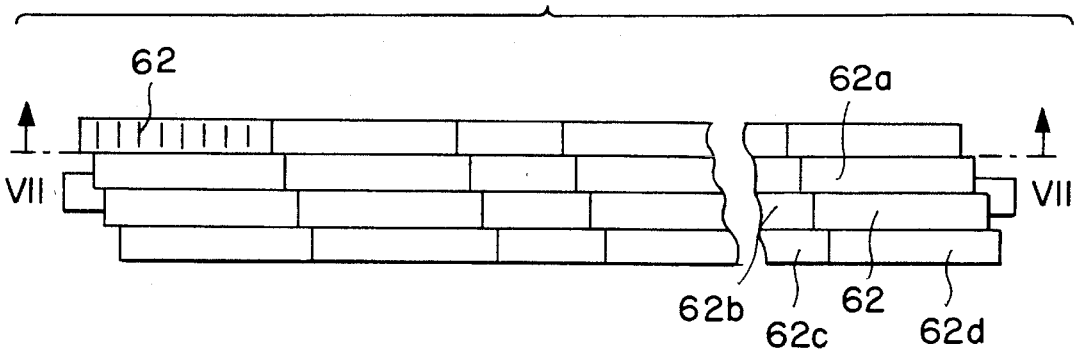
FIG. 6 control apparatus consisting of several modularly structured control devices viewed from the top.
Figure 7:
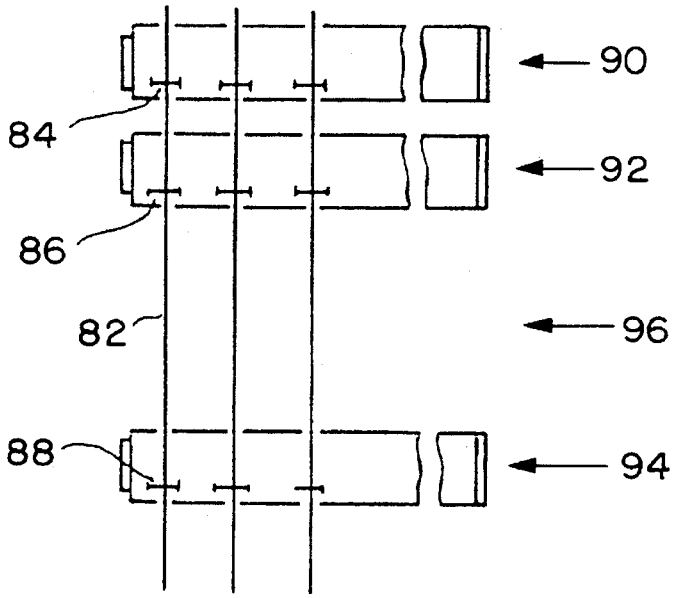
FIG. 7 the control device in FIG. 6 sectioned along the line VII—VII, shown diagrammatically.
Figure 8:
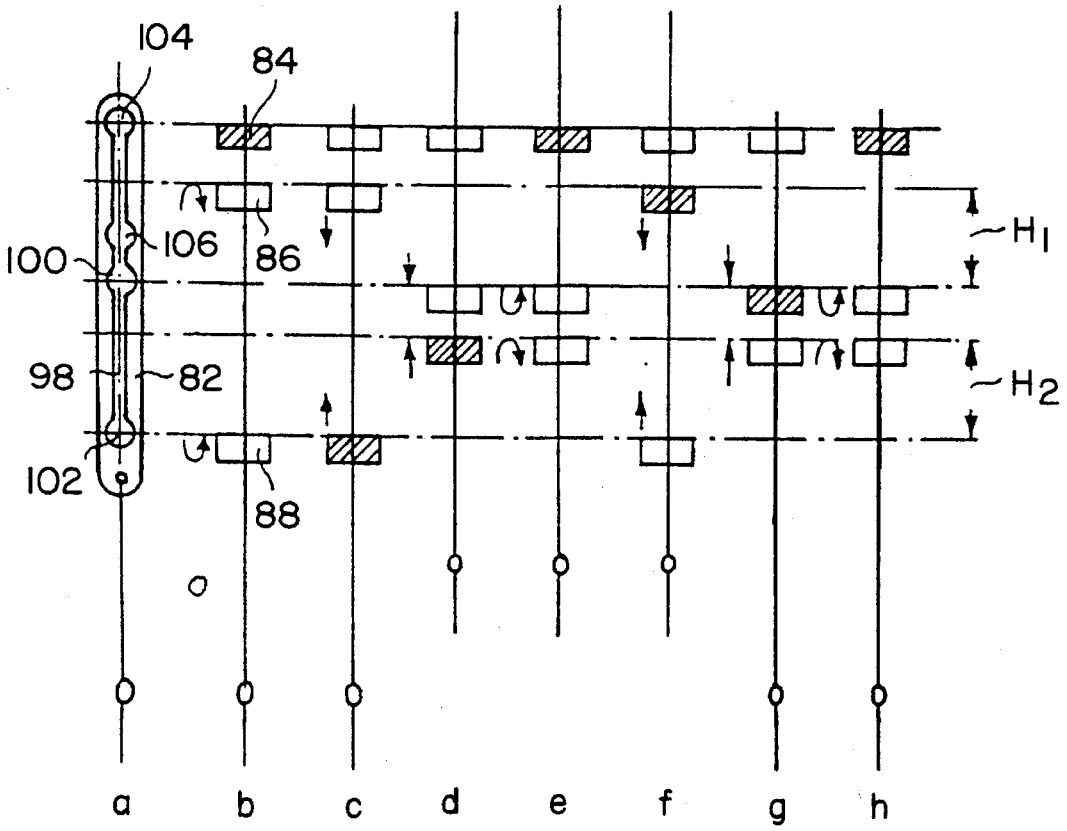
FIG. 8 mode of operation of the device in FIGS. 6 and 7 shown diagrammatically.

FIGS. 6 to 8 show a control device which is built up horizontally from modular units 62 of the control arrangement. A stationary coupling arrangement 84 and two coupling arrangements 86, 88 which can be moved up and down and are part of the lifting device are assigned in vertical direction to a traction member 82. The coupling arrangements 86, 88 are formed similar to the coupling arrangement 38 in FIG. 1. Each control arrangement of the control device functions in the same way as the control arrangement of FIG. 4, with the lifting knives 92, 94 corresponding to the lifting knives 34*a* and 34*b* of FIG. 4. The lifting knives 92 and 94 are respectively associated with the coupling arrangements 86, 88 which act on the traction member 82 that corresponds to the traction members 22*a*, 22*b* of FIG. 4. The row of the stationary coupling devices 84 constitute thus a stationary knife 90 and the row of the first mobile coupling devices 86 constitute an upper lifting knife 92 with the lift $H_1$, and the second coupling devices 88 constitute a lower lifting knife 94 with the lift $H_2$ all of the lifting device 96. The upper lifting knife 92 and the lower lifting knife 94 of the lifting device 96 operate in a push-pull manner. The traction member 82 comprises, apart from the longitudinal slot 98, three coupling bores or recesses 100, 102, 104, which are allocated respectively to the lowermost position of the lifting knives 92, 94 or to the stationary knife 90. Furthermore the traction member 82 has a fourth coupling bore 106, which cooperates with the coupling arrangement 84 of the stationary knife 90 in the lifted position of the traction member, as this is evident from FIG. 8. FIG. 8 shows following one another operational phases from a to h where respectively activated coupling devices are shown in a shaded manner in FIG. 8.

FIG. 8*a* shows the traction member 82 in the basic position, in which the traction member is held in the low position by means of a return spring which has not been shown in detail here and which is similar to the spring 30 shown in FIG. 1. In the drive phase shown in FIG. 8*b* the coupling arrangement 84 of the stationary knife 90 is activated and retains the traction member 82 in the low position, while the upper lifting knife 92 and the lower lifting knife 94 move away from each other into the farthest position from each other, as shown in FIG. 86. According to FIG. 8*c* the stationary coupling arrangement 84 of the stationary knife 90 is disengaged and the coupling arrangement 88 of the lower lifting knife 94 is activated whereupon the movement of the lifting knives 92, 94 oriented against one another starts until they have reached the adjustment shown in FIG. 8*d* and the traction member 82 is in the lifted position. Thereupon the coupling arrangement 88 of the lower lifting knife 94 is released and the stationary coupling arrangement 84 of the stationary knife 90 is activated according to FIG. 8*e*, so that the traction member 82 is retained in the top shed position. The upper lifting knife 92 and the lower lifting knife 94 move away from each other from a position of FIG. 8*e* into the position shown in FIG. 8*f*, in which the stationary coupling arrangement 84 of the stationary knife 90 is disengaged and the traction member 82 is coupled with the coupling arrangement 86 of the upper lifting knife 92. Thereupon the lifting knives 92, 94 move against one another from the position of FIG. 8*f* into the position of FIG. 8*g*, and the traction member 82 is again lowered into the bottom shed position according to FIG. 8*g*.

There the coupling arrangement 86 of the upper lifting knife 92 is disengaged and the stationary coupling 84 of the stationary knife 90 is activated, as shown in FIG. 8*h*, in order to hold the traction member 82 in the lower position, whereupon the lifting knives 92, 94 can again be moved away from each other from the position of FIG. 8*h* into the position of FIG. 8*b*.

Because of the horizontal subdivision of the knives into modular units, the control device can also be divided into individual blocks in vertical direction, wherein the electric lines are disposed in a matrix-like manner; this permits to reduce the quantity of the inlets and outlets of the control electronics to an acceptable and realizable quantity as is evident from FIG. 5. Since the individual modular units are interconnected by electric contacts, the individual modular units and partial blocks can be easily separated from each other, so that every unit and every block can be removed or replaced without removing the other blocks or units. Due to the modular units it is possible to combine different systems according to the width of the textile machine and the quantity of the warp threads.

I claim:

1. A control device for a yarn of a textile machine, said control device comprising:

a traction member connectable to the yarn;

means for lifting the traction member from a first position thereof corresponding to a low position of the yarn to a second position thereof corresponding to a high position of the yarn; and coupling means for retaining the traction member in the second position thereof, the coupling means including:

a link pin receivable in an opening formed in the traction member and displaceable between a neutral position, in which the traction member is capable of being displaced between the first and second positions thereof, and an engaged position, in which the traction member is retained in the second position thereof, and first and second piezoelectric switching members for displacing the link pin between the neutral and engaging positions thereof upon application of current to a respective one of the first and second piezoelectric switching members, the respective one of the first and second piezoelectric switching members being engageable by the link pin in a respective one of the neutral and engaging positions thereof and, in absence of application of current thereto, generating a signal indicative of a position of the link pin, thus functioning as a sensor.

2. A control device according to claim 1, wherein the link pin has a wide coupling segment, and wherein the traction member opening comprises at least one coupling bore for receiving the wide coupling segment, whereby the traction member is retained in the second position thereof.

3. A control device according to claim 2, wherein the link pin extends on opposite sides of the traction member, and the first and second piezoelectric switching members are located at opposite ends of the link pin, respectively.

4. A control device according to claim 2, wherein the traction member opening comprises at least two coupling bores disposed one above another.

5. A control device according to claim 1, wherein the traction member is directly connectable to the yarn.

6. A control device according to claim 1, further comprising connector means for connecting the traction member to the yarn.

7. A control device according to claim 1, wherein the traction member comprises two traction elements to be driven in push-pull manner, a connector cable for connecting the two elements, and a reversing roller around which the connector cable passes, the reversible roller being connected to the yarn.

8. A control device according to claim 1, wherein the coupling assembly forms a part of the lifting means and is displaceable upwardly and downwardly.

9. A control device according to claim 1, wherein the coupling assembly is stationary.

10. A control device according to claim 9, wherein the lifting means comprises two superimposed coupling devices having each a link pin, and wherein the traction member opening comprises three coupling bore for receiving the link pins of the coupling assembly and the two coupling devices, and a fourth opening which cooperates with the link pin of the coupling assembly after the traction member has been displaced to the second position thereof.

11. A control device according to claim 1, wherein the traction member and the coupling assembly form a modular unit, and wherein said control device further comprises another identical modular unit and means for connecting the two modular units together.

12. A control device according to claim 1, comprising a plurality of traction members and a plurality of coupling assemblies.

13. A control device for a yarn of a textile machine, said control device comprising:

a traction member connectable to the yarn;

means for lifting the traction member from a first position thereof corresponding to a low position of the yarn to a second position thereof corresponding to a high position of the yarn; and coupling means for retaining the traction member in the second position thereof, the coupling means including:

a link pin associated with the traction member and displaceable between a neutral position, in which the traction member is capable of being displaced between the first and second positions thereof, and an engaged position, in which the traction member is retained in the second position thereof, and first and second piezoelectric switching members for displacing the link pin between the neutral and engaging positions thereof upon application of current to a respective one of the first and second piezoelectric switching members, the respective one of the first and second piezoelectric switching members being engageable by the link pin in a respective one of the neutral and engaging positions thereof and, in absence of application of current thereto, generating a signal indicative of a position of the link pin, functioning as a sensor.

* * * * *